US005168883A

United States Patent [19]

Winn, deceased

[11] Patent Number: 5,168,883

[45] Date of Patent: Dec. 8, 1992

[54] APPARATUS FOR APPLYING TAX STAMPS TO CIGARETTES IN CARTONS AND FOR REPACKING CARTONS

[75] Inventor: Raymond W. Winn, deceased late of Apopka, Fla. by Susan J. Winn, legal representative

[73] Assignee: American Decal & Mfg. Co., Chicago, Ill.

[21] Appl. No.: 219,379

[22] Filed: Jul. 14, 1988

[51] Int. Cl.[5] ..... A24D 5/60; B65B 19/24

[52] U.S. Cl. ..... 131/283; 131/284; 53/58; 53/75; 53/504; 53/252; 156/DIG. 2; 156/DIG. 4

[58] Field of Search ..... 131/280, 282, 283; 53/50, 51-58, 75, 504, 498, 148, 252; 156/DIG. 2, DIG. 4

[56] References Cited

U.S. PATENT DOCUMENTS 3,906,705 9/1975 Beck ..... 53/252

4,955,125 9/1990 Herrington ..... 53/252

*Primary Examiner*—V. Millin

*Attorney, Agent, or Firm*—Marshall, O'Toole, Gerstein, Murray & Bicknell

[57] ABSTRACT

An apparatus for automatically applying trasfers to packages in any size of cartons, such as revenue stamps to cigarettes while in cartons. Initially, cigarette cartons of any size are loaded onto a conveyor belt where they are carried to the various stations of the apparatus. The apparatus is automatically adjustable to any size of carton by means of photoelectric cells. As the cartons are pushed through the apparatus, an improved plow head opens the cigarette cartons in preparation for stamping. Just before stamping, any improperly opened cartons are automatically ejected. An improved stamp indexer scans the stamps photoelectrically so a motor advances the correct number of stamps so that waste is reduced and defective stamping is avoided. Next, a gluing station applies glue to ensure that flaps stay down when the cartons are reclosed. Finally, the cartons are discharged onto a conveyor where a packing station aligns them and pushes them row by row into a case for shipment.

8 Claims, 6 Drawing Sheets

APPARATUS FOR APPLYING TAX STAMPS TO CIGARETTES IN CARTONS AND FOR REPACKING CARTONS

BACKGROUND OF THE INVENTION

The present invention relates to apparatuses for the application of revenue tax stamps to cigarettes and, more particularly, to a machine that stamps the individual cigarette packages without having to remove them from the carton and which repacks the cigarette cartons back into cardboard cases when finished.

Under the laws of all states, each package of cigarettes must contain a tax stamp before it can legally be sold. Since almost every state has a different tax rate, stamping must take place at the wholesale level of distribution. Current procedures require that the wholesaler in each state buys cigarettes from the manufacturer, then must open each carton, apply a tax stamp to each pack and then reseal the cartons and repack them into a cardboard case before passing it to the retail level for sale.

The prior art includes several machines that automatically open and stamp individual cigarette packs and reseal the carton. Unfortunately, such machines are limited to stamping standard cigarette cartons consisting of two rows of five packs of approximately $1\frac{7}{8}$ inches by 11 inches, with a height (commonly measured in meters) of 100 millimeters. However, primarily for marketing purposes, manufacturers have reintroduced cigarettes with many sizes and having many different arrangements in cartons that cannot be stamped with existing machines. For instance, manufacturers have introduced cartons having only one row of ten packs, which are $2\frac{3}{4}$ inches wide by 9 inches long, as well as the traditional two by five pack cartons with cigarettes up to the 120 millimeters in height.

Since no machine which can stamp odd sizes is available, wholesalers have had to stamp cigarette packages contained in such cartons manually—a slow and expensive process. In fact, tobacco manufacturers have found it necessary to pay wholesalers' substantial sums of money just to apply tax stamps to such non-standard sized and arranged cartons.

The most pertinent prior art in this area include U.S. Pat. Nos. 4,101,362 by Baker et al.; 3,813,268 by Kerwin; 3,513,616 by Davis; 3,306,807 by Schclotthauer; 3,121,300 by Rossi and 3,025,211 by Winn. With the exception of the Baker and Davis patents, none of the aforereferenced patented apparatuses are adjustable to accommodate various sizes and arrangements of cigarettes. The Davis apparatus is variable only for certain specified sizes of cigarette cartons such as cartons for regular, king or imperial cigarettes. The Baker apparatus dicloses a machine and a method for applying transfers which accommodates various cigarette package sizes but requires that their cartons be placed on the side for passage through the machine. The Baker apparatus has manual stops which measures the size of the carton before opening it at the stamping stations.

Contrary to the above prior apparatuses, the instant invention does not require that the cartons be placed on the sides and automatically adjusts by means of photoelectric cells to any size and arrangement of cigarette cartons. In addition to being infinitely adjustable, the instant apparatus also repacks the cigarette cartons back into the case once stamping is completed, an accomplishment which no prior machine can claim.

SUMMARY OF THE INVENTION

The primary object of this invention is to provide an apparatus to apply stamp labels to individual cigarette packages in a carton without having to remove said packages from the carton.

Another object is to provide such an apparatus that will apply revenue or tax stamps to all existing sizes and arrangements of cigarette cartons.

A related object of the invention is to provide an apparatus which anticipates future packaging developments, particularly in cigarettes, by being infinitely able to accommodate variables in height, width and length of cigarette cartons.

A further object of the invention is to provide such an apparatus which more effectively and accurately applies tax stamps to cigarette packages.

An additional object of the invention is to provide an apparatus which also replaces and repacks the cigarette cartons into cases.

An even further object of this invention is to provide an apparatus which is easy to operate and which requires no manual adjustment.

The instant invention accomplishes the above and other objects by providing an improved stamping machine which performs all of the steps or the stages necessary to the automatic application of tax stamps to cigarette packages which are still in the carton and then repacking those cartons back into the cases.

The apparatus has several stations. First, the cigarette cartons are loaded onto a conveyor that moves them against a chain having pads attached thereto for pushing the cartons through the apparatus. Next, a photoelectric system determines the height of the opening and stamping heads. Then, the chain forwards the carton under the opener or "plow" head to open the flaps on the carton. The carton is then forwarded under the stamping head, at which time photoelectric sensors scan the flaps on the carton to see if they are opened properly. If the flaps are not open, the cartons are ejected automatically down a chute from the machine. If the flaps are open properly, then the cigarette packages are stamped. After stamping, each carton moves through a station that glues the flaps and recloses them. The cartons then land on a conveyor where the cartons are pushed toward a stop. Once enough cartons are gathered at the stop to form one row in a case, the cartons are pushed into a case and the case is lowered by the apparatus for another row to be inserted until the case is entirely repacked with cigarette cartons, thereby completing the stamping process.

Other objects, advantages and features of the invention will become readily apparent from the following detailed description of the specific embodiments thereof when read in conjunction with the accompanying drawings.

BRIEF DESCRIPTION OF THE DRAWINGS

The drawings which accompany this specification are as follows.

DETAILED DESCRIPTION OF THE PREFERRED EMBODIMENT

Figure 1:
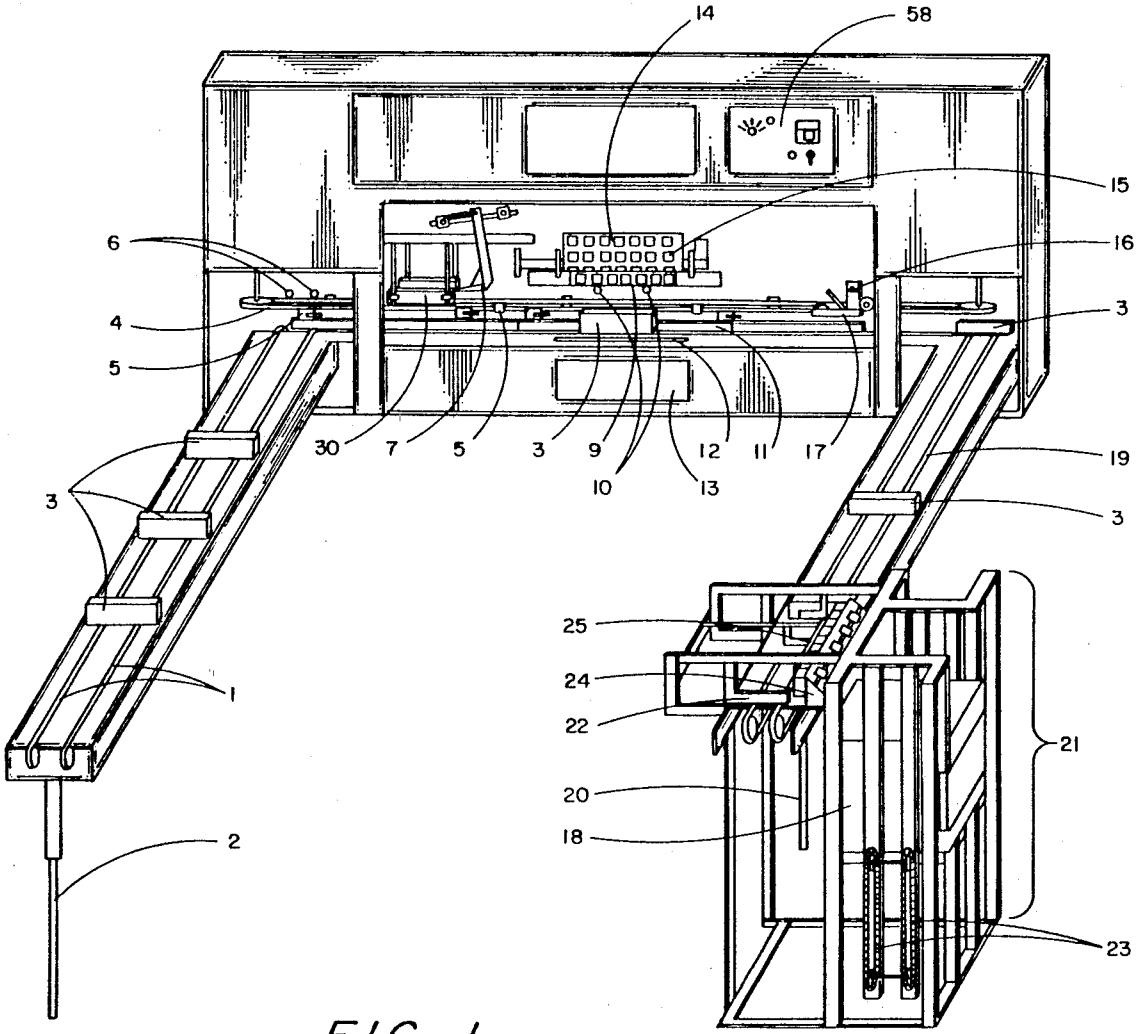
FIG. 1 is a perspective view of the entire invention showing all the stations of the apparatus.
Figure 2:
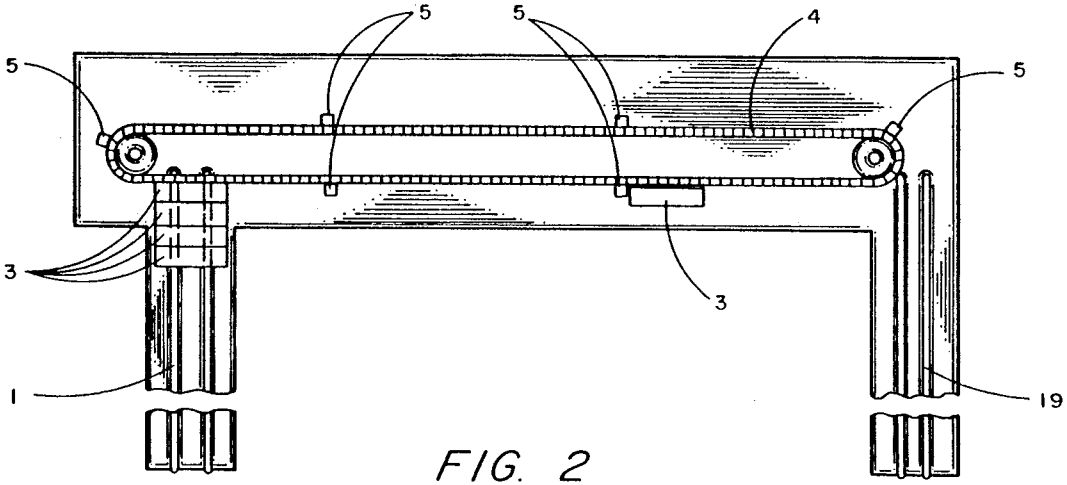
FIG. 2 is a top plan view of the invention showing the path of the cartons through the apparatus.

For purposes of discussing the instant invention in conjunction with the accompanying drawings, the invention has been divided into seven (7) stations as follows: (1) loading; (2) sizing; (3) opening; (4) stamping; (5) gluing and closing; (6) discharging; and (7) repacking. FIGS. 1 and 2 show the entire invention in perspective and in top plan view, respectively.

The initial or loading station consists of a conveyor belt 1 with support pole 2 onto which cigarette cartons 3 are loaded. The conveyor 1 moves the cartons 3 against a chain 4 with pads 5 attached thereto for propelling the cartons 3 through the apparatus.

A feature of the instant invention not present in prior machines is that cigarette cartons 3 can be loaded with the flaps in either direction. This feature is significant since cigarette cartons have two flaps, one large and one small. In conventional machines the cartons 3 must be loaded with all the flaps oriented with the small flap on the left. If the cartons 3 are loaded any other way, the flap will be torn off by the machine. With the instant invention, the cartons 3 can be loaded either way with no tearing of the flaps.

The second station is the sizing station in which photoelectric cells 6 size the cartons 3 by determining the height and automatically adjusting the height of the opening plow head 7 and stamping heads 8. Unlike machines in the prior art which may adjust for different sizes of cartons manually by using knobs or shims that are placed in the bottom of the conveyor, the instant invention provides photoelectric means for adjusting the heads in an infinitely variable manner. Even the prior machines which perform this adjustment only go to pre-set heights, that is regular king or 100 millimeter cartons, so that if a 92 millimeter height carton were to come through, the machine would not be able to handle it.

Figure 4:
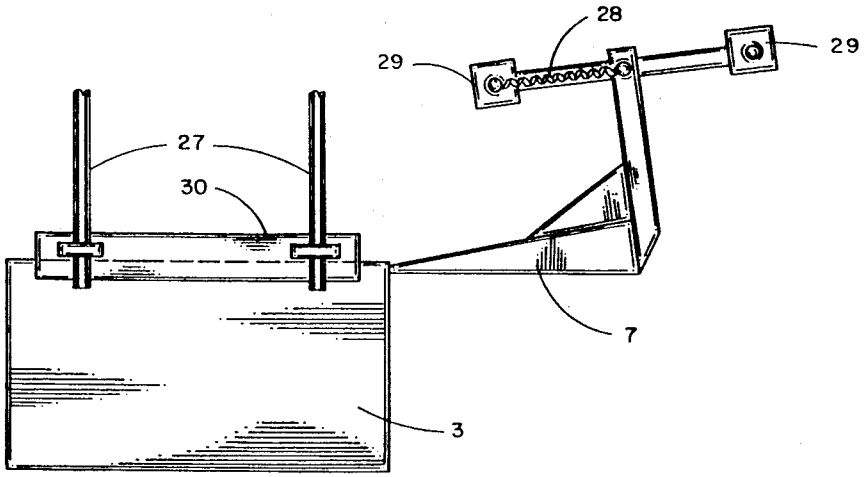
FIG. 4 is a side view of the opening station.
Figure 3:
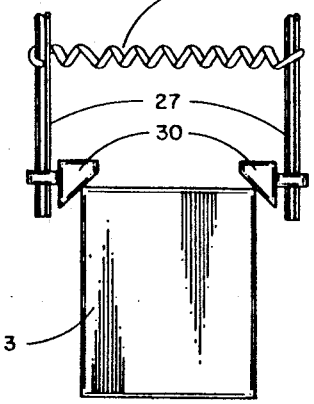
FIG. 3 is a front view of the opening station of the apparatus.
Figure 5:
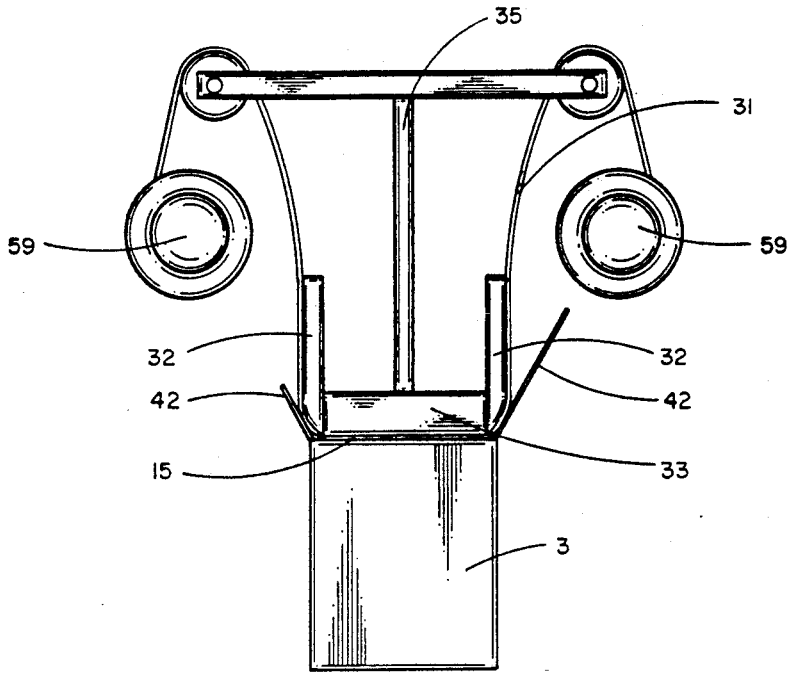
FIG. 5 is a partial side view of the stamping head of the apparatus.

The third station of the instant apparatus is the opening station, shown in more detail in FIGS. 4 and 5, wherein the chain 4 forwards the cartons 3 between two beveled pinch rollers 26, each connected to rods 27 and spring-loaded by a spring 28. The pinch bars 30 squeeze the carton 3, causing the flaps to pop up, thereby making entry of the plow knife 7. In prior apparatuses the opener or plow knives 7 are fixed, which is a disadvantage since if a carton 3 is too low it will not open, or if it is to high it rips the cigarette packages in the carton, causing the tobacco to fall on the floor. On the other hand, the improved plow head 7 of this invention is mounted on a rod 30 with linear bearings 29 and is designed to hit low on the cartons 3. As a carton advances, the plow knife 7 moves upward until it plunges under the flaps just before reaching the top of the carton. In this manner, even if a carton 3 is tipped upward, the knife 7 moves with the carton 3 until it reaches the level of the flaps so that it opens the flaps without damaging the carton.

The fourth station is the stamping station wherein the carton 3 is forwarded under the stamping head 9, and at this stage the photoelectric cells 10 scan the flaps on the carton 3 to see if they are opened properly, at which time one of two decisions is made depending on the result of the scan—either (1) the carton 3 is ejected if the flaps are not open or (2) the cigarette packs within the carton 3 are stamped if the flaps are open. In the former case, a push bar 11 pushes the carton 3 forward so that it falls into a slot 12 and down into a chute 13 for easy removal. In contrast to this improved stamping stage of the instant invention, prior inventions do not automatically eject unopened or partially opened cartons, but rather may often stamp open cartons, thereby wasting stamps.

The stamping stage also contains another improvement, that is, an improved stamp indexer 14 in which the stamps 15 themselves are also scanned photoelectrically such that when two rows of stamps are advanced, a rewind motor shuts off and at the same time rewinds the paper into a neat row. For stamp indexing, the prior inventions use a rollaway pin which pulls the paper through the machine by engaging holes on the edge of the paper. Although such pins are indexed for two rows, the sheets of paper containing the stamps did not always move two rows because the paper frequently comes off the pins, thereby resulting in poor stamping and/or wasted stamps. Also, at the same time, the waste paper falls from the machine into a waste box or on the floor which can be dangerous since the paper is waxed and, therefore, very slippery.

Figure 6:
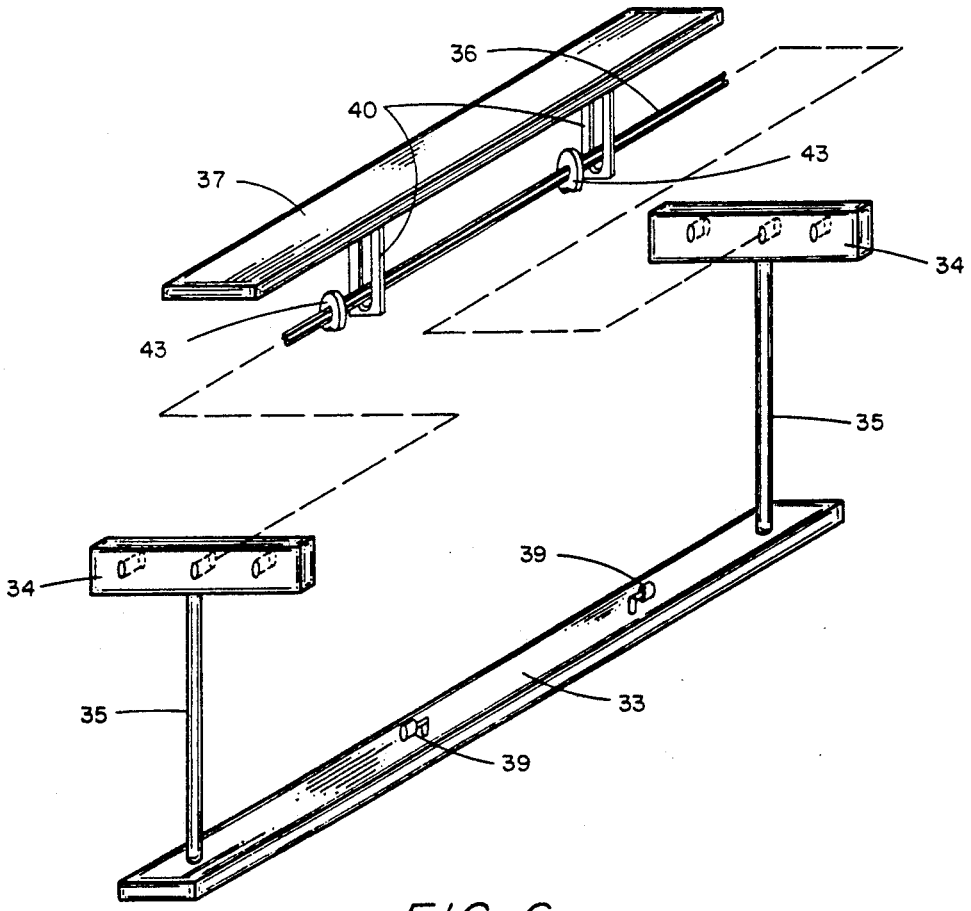
FIG. 6 is a disassembled perspective view of the stamping head portion of the apparatus.

The stamping head portion of the stamping station is shown in further detail in FIGS. 5 and 6 of the drawings. When the carton 3 comes to rest under the stamp head heater 33, the heater 33 is up and off the stamp 15 and the carton 3, not as shown in FIG. 5. When the camshaft 36 (shown in FIG. 6) cycles, the entire stamp head portion with heater 33 and rod 35 comes down between the stamp guides 32 and pushes the stamp web 31 against the carton 3, thereby transferring the stamps 15 to the packs of cigarettes within the carton 3. In the disassembled view of the stamping head shown in FIG. 6, the camshaft 36 is suspended from the frame 37 of the apparatus by a holder 40. The holder 40 has rollers 39 with indentations 43 on which the cams 38 rest. Thus, when the camshaft 36 rotates, the cams 38 also rotate so that the camshaft 36 comes out of the indentations 43 and rotate against the outer circumference of the cams 38, thereby pushing the heater 33 downward on the cigarette carton 3.

The fifth station of the invention is the gluing and closing station wherein the chain 4 moves the carton from the stamping station for gluing and reclosing. Previous apparatuses have used water soluble glue that causes the carton flaps to pop back up, often making the carton difficult to handle and pack back into the cardboard case 18 when it is discharged.

Figure 8:
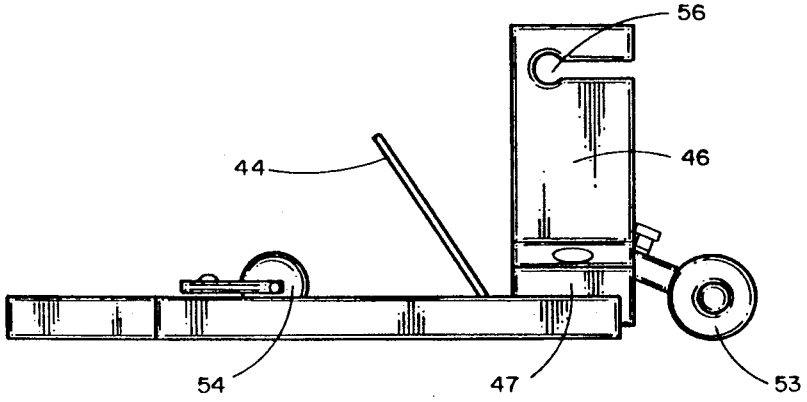
FIG. 8 is a side view of the closer portion.
Figure 7:
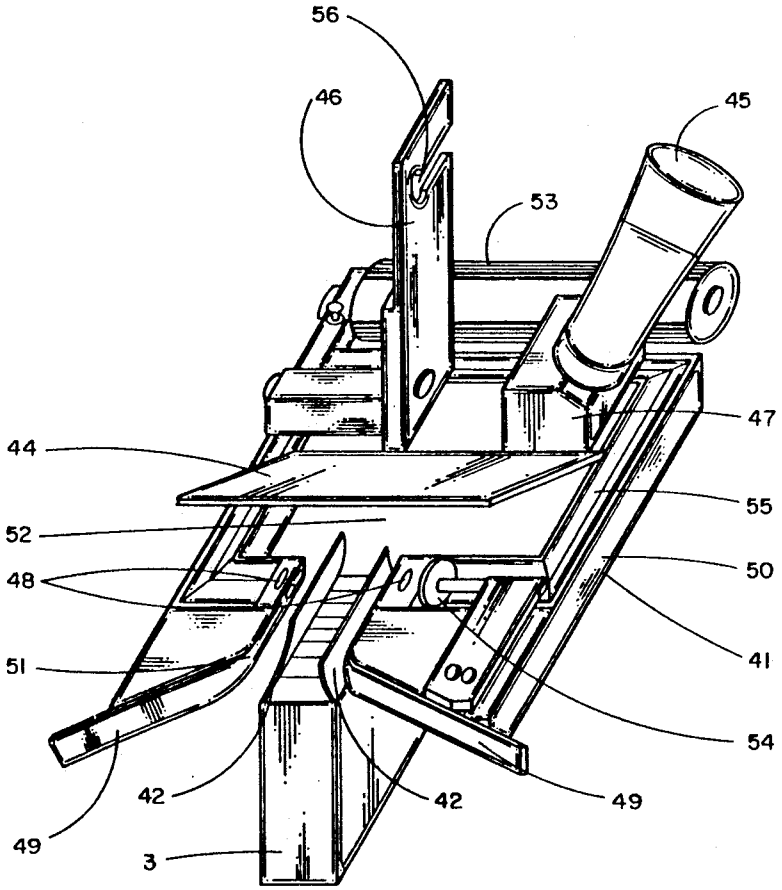
FIG. 7 is a perspective view of the closer portion of the apparatus.
Figure 9A:
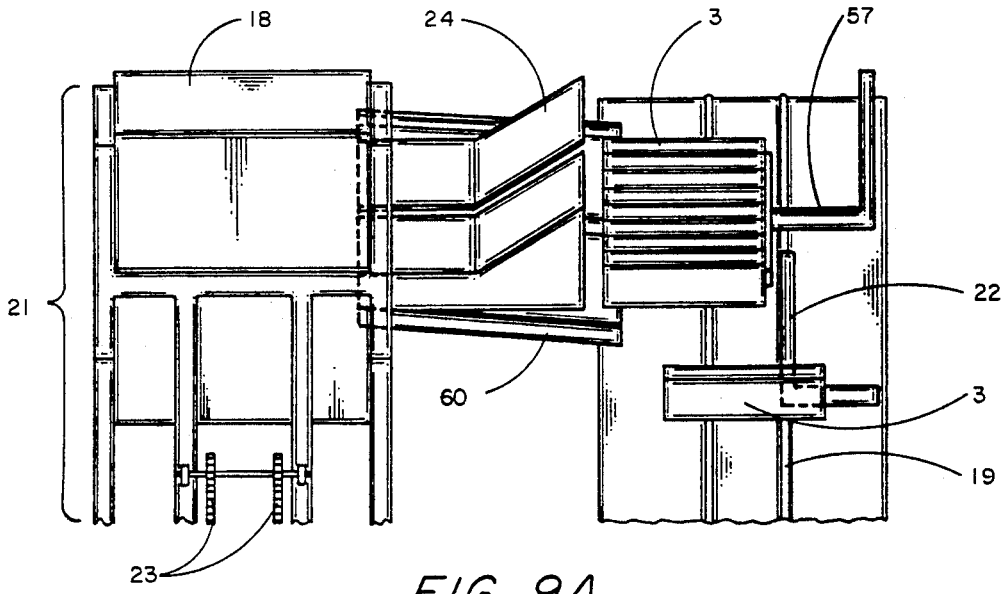
FIGS. 9A, 9B and 9C are side plan views of the case packing station of the apparatus during various stages of the case packing process.
Figure 9B:
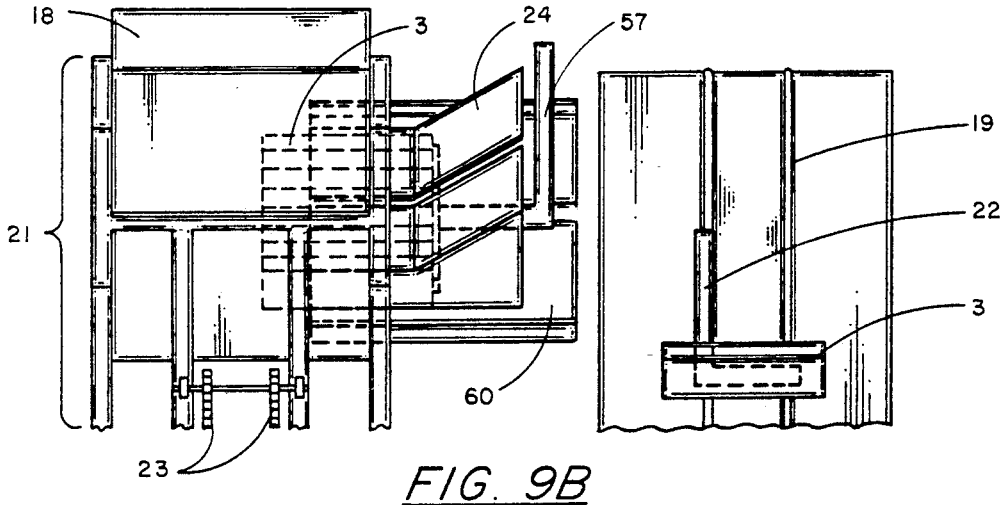
Figure 9C:
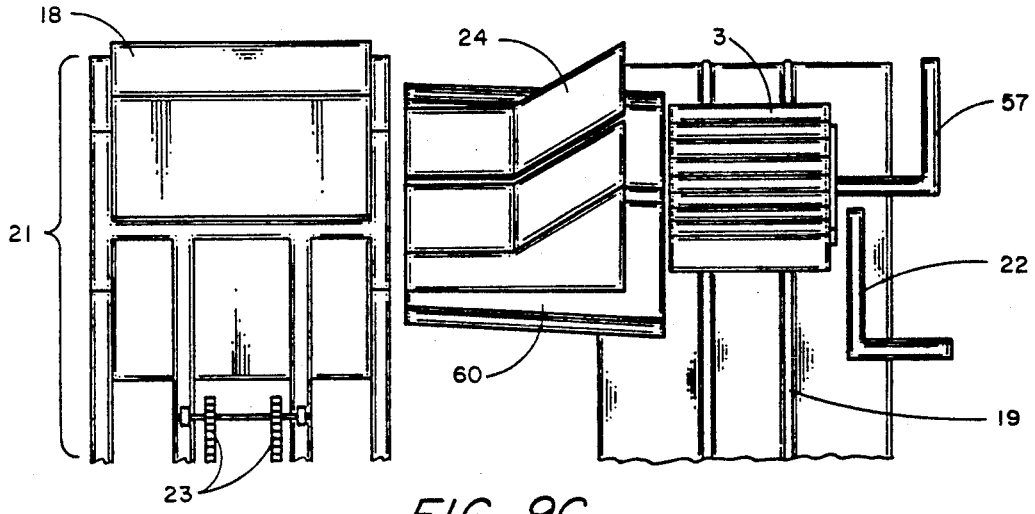
Figure 10:
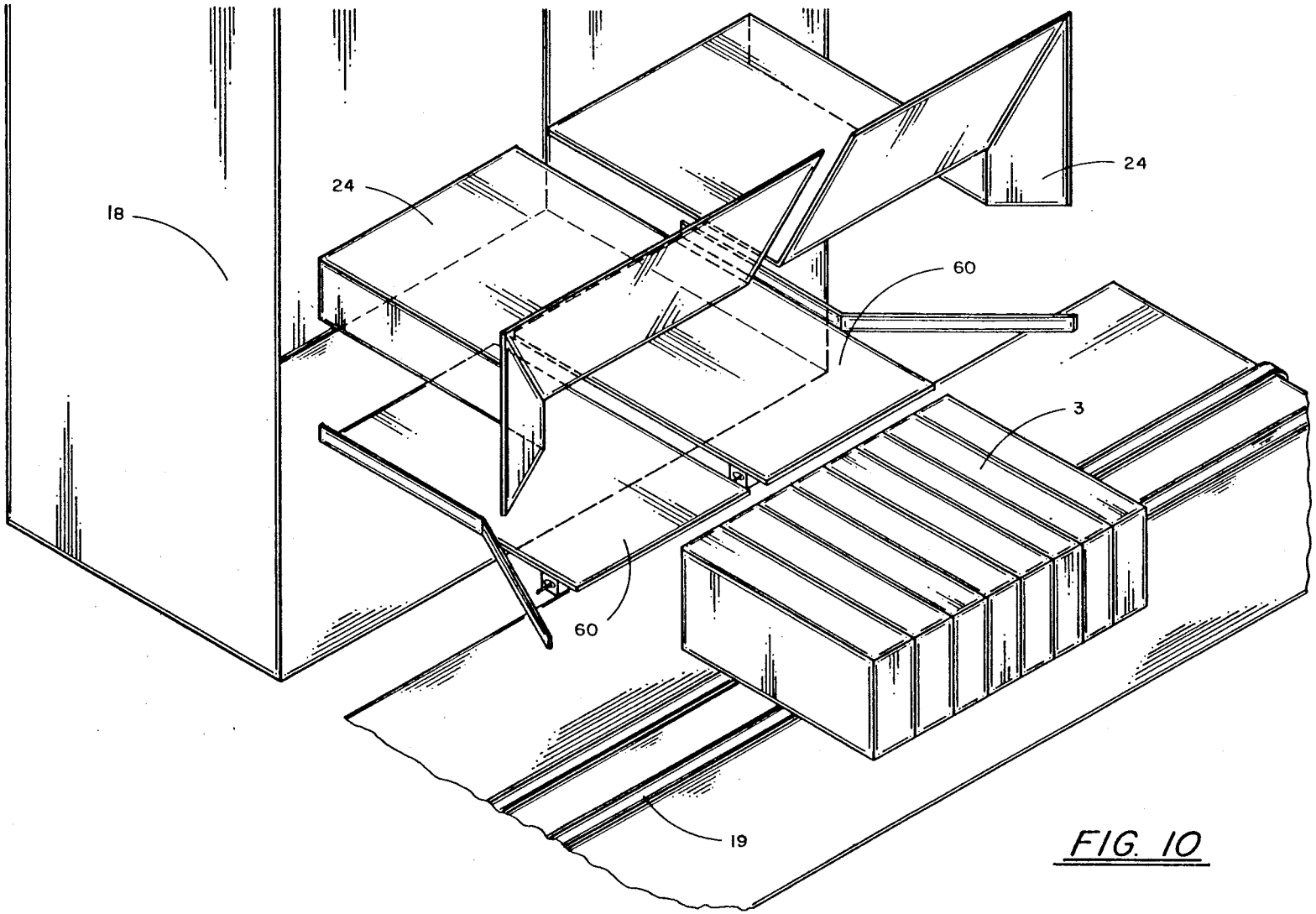
FIG. 10 is an enlarged perspective view of a portion of the case packing mechanism of the apparatus.

FIGS. 7 and 8 show the closing station of this apparatus in enlarged detail. A sliding bracket 46 with slot 56 at the top of the closer attaches the closer portion to the apparatus. Glue contained in a glue bottle 45 is mounted on a support 47. The glue flows from the bottle 45 into a glue trough 55 toward the front of the closer at the side roller 54 and glue wheels 48. As the cigarette carton 3 moves through the flap guides 49, the flaps 42 rub against the flap guides 51, whereupon glue is applied to the flaps 42 by the glue wheels 42. Then as the carton passes into the opening 52, the carton flap closer 44 pushes the flaps downward and the closing roller 53 pushes the flaps 42 shut.

The sixth station of the invention is the discharge station. After the cartons 3 are glued and reclosed, the chain 4 advances the cartons 3 to an outgoing conveyor 19 with support pole 20 for passage to the seventh station, at which time the cigarette cartons 3 are repacked into the cardboard cases 18.

As shown in FIGS. 9A, 9B, 9C and 10 of the drawings at the packing station, the cartons 3 of cigarettes have been deposited on a conveyor belt 19. The cartons 3 are propelled into the case-packing mechanism 21 against a stopper 22. When one row of cartons 3 have gathered against the stopper 22, a ram 57 actuates and pushes a row of cartons into the cardboard case 18. The case 18 is then lowered automatically by chain drive 23 an amount exactly equal to the height of the row that was just inserted into it. When another row of cartons 3 accumulates against the stopper 22, it is pushed into the case 18 and again the case 18 lowers. The process of fill, lower, fill, lower . . . is repeated until the case 18 is entirely full. The filled case 18 may then be dropped onto another conveyor to be taken to another part of the warehouse as desired.

To facilitate entry into the case 18, a "shoe-horn"-type guide 24 is employed. This shoe-horn guide 24 is a sheet metal box that enters the case 18 first. It is split into quadrants and is movable in all directions on linear bearings (not shown) so as to automatically assume the size and shape of any row of cartons 3. After entering the case 18 first, then the row of cartons 3 is forced into it, spreading it to the proper width, and raising it to the proper height. An angled ramp on the bottom of the guide 24 assures that the flaps 42 of the previous row are smoothed down and the row entering the case 18 glides freely into it.

After the row is deposited into the case 18, a motor (not shown) lowers the case until a photocell sees the top of that row. This arrangement provides automatic compensation for the many different sizes of cigarettes and no manual adjustment is necessary. Thus, it makes no difference whether "regular" cigarettes (which are 2¾ high) or 120 millimeter cigarettes (which are 5" high) are being cased; the case-packing mechanism 21 is automatically lowered to the proper level.

While the ram 57 is pushing the row into the case 18, a gate 25 follows it into the loading area to keep out any other cartons that might have accumulated on the conveyor belt 19. This gate 25 automatically retreats with the ram 57 when the ram 57 returns to its starting position, thereby allowing the loading area to fill again.

As described in detail hereinabove, it should be apparent that there has been provided a new, useful and nonobvious apparatus for more effective application of transfer stamps to cigarettes while in the carton which contains many distinguishing features and advantages over the prior art.

One advantage is that the instant device provides means for automatically adjusting for different carton heights, contrary to prior devices in which it had to be done manually using knobs or shims placed in the bottom of the conveyor. Moreover, this adjustment capability is infinitely variable, whereas prior apparatuses can only adjust to certain pre-set heights such as regular, king, 100 millimeter, and so on.

Another advantage is that the cartons can be handled no matter what direction they are placed in the apparatus. For instance, even if the cartons are turned around or tipped, the apparatus still works so that cartons of cigarettes are not ripped or tobacco is not spilled on the floor, as with prior machines.

A third advantage is that means have been provided for automatically ejecting unopened or partially opened cartons. When a photoelectric cell indicates that the cartons are not open, the carton is pushed out of the way and downward. In prior apparatuses such a closed carton would stop the entire operation, and the operator would have to remove it manually, thereby wasting time.

An improved stamp indexer is also provided by this invention. The stamps are scanned photoelectrically and when two rows are advanced, the rewind motor shuts and at the same it rewinds the paper into a neat roll. In prior devices the rollers had pins which pulled the paper through the machine by engaging holes on the edge of the paper. The paper would frequently come off the pins and the result would be poor stamping or wasted stamps. Also, in prior apparatuses the waste paper just falls out of the machine to a waste basket or on the floor, which would make a mess, and since the paper is slippery, it could be dangerous.

An even further improvement in this device, which was described earlier in detail, is an improved flap gluer. The flap gluer of the instant apparatus is a hot melt applicator which rolls across the inside flap just before the closing process to firmly seal the carton.

Finally, another major novel advantage of this instant device is a packing system which fits onto the end of the out conveyor belt. This packer uses a ram to push a row of cartons into a shoe-horn like device and back into a cardboard case from which they originated.

While a specific embodiment of the invention has been described in detail hereinabove, it is to be understood that various modifications may be made from the specific details described hereinabove without departing from the spirit and scope of the invention as set forth in the appended claims.

What is claimed is:

1. An apparatus for applying transfer labels and tax stamps to cigarettes packaged in cartons comprising:

a first loading station having a conveyor belt to carry the cartons to a chain having pads attached thereto for pulling the cartons through the apparatus;

means for measuring the height and size of the incoming cartons and automatically adjusting the height of opening and stamping head comprises a series of photoelectric cells which emit a light directed toward the cartons at the loading station, said light providing an electric signal for lowering or raising the opening and stamping head;

means for opening the cartons;

means for automatically determining whether flaps on the cartons are properly open and ejecting any unopened or partially opened cartons;

means for stamping the items packaged in the cartons; and means for gluing and reclosing the cartons.

2. The apparatus of claim 1 wherein the means for opening the cartons comprises advancing the carton through spring-loaded pinch bars to cause the flaps on the cartons to bulge upward so that a slanted plow head can push under the flaps until the flaps are opened.

3. The apparatus of claim 1 wherein the means for automatically determining whether the cartons are properly opened and for ejecting any unopened or partially opened cartons comprises a photoelectric cell which scans the flap of the carton to determine if the carton is opened properly and a bar which pushes said carton away from the conveyor so that it drops down a chute and away from the apparatus if the carton is not opened properly.

4. The apparatus of claim 1 wherein the means for stamping the items packaged in the cartons comprises a motor that advances stamps or transfer labels over the items separated by two guides, between which guides is a heater which is pressed down by the rotation of a camshaft onto the stamps against packs in a carton so that the transfer labels are applied.

5. The apparatus of claim 1 wherein the means for gluing and reclosing the cartons comprises a reservoir containing glue, said reservoir having electric means for heating the glue and a central disbursement section which is intersected by an applicator wheel, said applicator wheel being turned by a motor so as to apply glue to the flap of the carton passing thereby and a roller to press down the flap to secure same.

6. The apparatus of claim 1 further comprising means for repacking the cartons into a case.

7. The apparatus of claim 6 wherein the means for packing the cigarette cartons into a case comprises a conveyor which gathers sufficient cartons to form one row in a case, at which time a ram pushes the cartons into a "shoe-horn" like guide into the case, at which time the case lowered by motorized means until a photocell sees the top of that row of cartons, at which time the case is in position for loading another row of cartons.

8. An apparatus for packing cigarette cartons and like cartons into a case comprising a conveyor which gathers sufficient cartons to form the length of one row in a case, and a ram to push the cartons into a "shoe-horn"-like guide into the case, at which time the case is lowered by motorized means until a photoelectric cell sees the top of that row of cartons, at which time the case is in position for loading another row of cartons.

* * * * *